United States Patent [19]

Ring et al.

[11] Patent Number: 4,477,495

[45] Date of Patent: Oct. 16, 1984

[54] METHOD AND APPARATUS FOR PREPARING THERMOPLASTIC COATED WEBS AND PRODUCTS THEREOF

[75] Inventors: Michael Ring, Warwick, N.Y.; William K. Kirk, Carey, N.C.

[73] Assignee: International Paper Company, New York, N.Y.

[21] Appl. No.: 440,412

[22] Filed: Nov. 9, 1982

[51] Int. Cl.[3] ..... B05C 3/02; B05D 3/12

[52] U.S. Cl. ..... 427/356; 118/415; 427/358; 427/365; 427/366

[58] Field of Search ..... 427/358, 365, 366, 356; 118/415, 126

[56] References Cited

U.S. PATENT DOCUMENTS

| | | | |
|---|---|---|---|
| 600,676 | 3/1898 | Menzie . | |
| 1,729,368 | 9/1929 | Timmons . | |
| 1,812,809 | 1/1931 | Steele . | |
| 2,227,530 | 1/1941 | Binns . | |
| 2,329,378 | 9/1943 | Kuehner . | |
| 2,426,572 | 8/1947 | Alderfer . | |
| 2,874,407 | 2/1959 | Chabot et al. . | |
| 3,167,442 | 1/1965 | Brooks . | |
| 3,230,928 | 1/1966 | Stalmuke | 118/413 |
| 3,604,394 | 9/1971 | Ohno | 118/415 |
| 3,690,292 | 9/1972 | Pasley, Sr. | 118/415 |
| 3,742,902 | 7/1973 | Heston, Jr. | 118/415 |
| 4,109,034 | 8/1978 | Welch | 427/355 |
| 4,143,187 | 3/1979 | Pilgrim et al. | 427/358 |
| 4,239,821 | 12/1980 | McLean et al. | 427/358 |
| 4,331,099 | 5/1982 | Topfer | 118/415 X |

*Primary Examiner*—Michael R. Lusignan

[57] ABSTRACT

A machine for coating a sheet material having an impervious surface and for impregnating as well as coating a porous web with high viscosity filling and coating materials in aqueous or non-aqueous suspension form.

The machine has a smooth web support in the form of a flat table or, alternatively, a rotating drum, and an applicator in the form of an inverted box forming one or more pressure chambers extending across the table and under which the web is fed over the web support. The walls of the applicator, which extend across the table, form at least first and second blade elements adjustably positioned with their lower edges in close proximity to the table surface. The lower edge of the first is positioned above the table a slightly greater distance than the lower edge of the second.

When coating material is deposited in excess across the web in front of the first blade element, the material thus carried on the web may enter the applicator under the first blade element at a rate faster than it may leave under the second blade element, thereby building up its pressure in the chamber, which drives the material into the web to impregnate it.

The machine may have a second pressure chamber with a third blade element to apply a second coating over the first and be combined with a web former and associated equipment, such as fiber pre-bonding and drying equipment, so as to produce a coated or a filled and coated end product from its basic components, depending on whether the substrate to be treated is non-porous or porous.

52 Claims, 21 Drawing Figures

212
210
206
202
206
216
208
204
204
188
160
180
214
190
194
163
178
176
182
192
173
172
184
142
175
186
174
110
146
104
174
105
103
107

METHOD AND APPARATUS FOR PREPARING THERMOPLASTIC COATED WEBS AND PRODUCTS THEREOF

BACKGROUND OF THE INVENTION

This invention relates to the problem of impregnating and coating porous webs, and coating but not necessarily impregnating surfaces having little or no porosity, with coating material in aqueous or non-aqueous slurry form, particularly with such material in highly viscous form. The expression "coating material" as used herein should be taken to include both material which simultaneously impregnates a porous web and coats its surface, and material which coats a porous or nonporous web with little or no penetration.

In the formation of many products in flat sheet form it is desirable to be able to apply to a base web a highly viscous material either as a coating or as both an impregnating and a coating material. An example of a product which is both impregnated and coated is a blackout screen formed from a porous web with the same material applied both to impregnate and coat it. An example of a product which is primarily coated with but a small degree of penetration is backed carpet made by coating the back or under side of a needle-punched carpet with a highly viscous material which locks the fiber tufts in place and provides an abrasion-resistant, crush-proof backing with excellent flexibility. In either case, what may start out as a highly irregular surface will end up with a smooth overcoating.

The problem of filling as well as coating with a highly viscous material has been solved in various ways, but these have their limitations. The use of high viscosity foams is well known in the carpet trade, but such foams tend to be pressure sensitive and also to powder on aging.

Treatment by dipping in a bath of coating material and then squeezing off the excess between rolls is another common coating method but it is not acceptable where one surface must remain uncoated, as in carpet manufacture, or where it is desired to hide the texture of the support fabric.

In order to impregnate a porous web and then build up a substantial thickness of coating on its surface or to form a thick coating on a non-porous substrate, it is generally necessary to run the substrate through a succession of at least two separate coating operations. In addition to the high cost of running a web through successive operations, such sequential treatments have serious disadvantages in terms of result as compared to what can be produced in a single operation with the method and apparatus of this invention. During successive coatings blistering may occur when air bubbles are produced in gaps between two strata of coating due to poor adhesion as between a dry first coat and a second coat, particularly if the second coat is a better film former or more elastomeric than the first coat. Flaking and cracking may also result from poor adhesion. Uneven surfaces also result from cockles which occur in papers being coated because of uneven stresses due to variations in moistures across the sheet. In a two stage coating operation, such conditions can be initiated in the first coating pass and magnified in the second coating pass. Thus, it would not only be much more economical to be able to fill and thickly coat a porous web and thickly coat a non-porous surface in one pass through a single coater, but the above described process disadvantage of successive coating would be eliminated.

But there are limitations in how filling and coating porous webs can be accomplished no matter how it is done because the fibers of many desirable base webs, particularly non-woven mats, are held together by thermoplastic fibers and/or heat or solvent-vulnerable binder materials so that such webs cannot stand the application of hot or solvent system materials without disintegrating.

It therefore becomes desirable to be able to impregnate and coat a porous web in one pass; to be able to coat either an impervious substrate or a porous web with a nondestructive coating material, namely, a coating material in aqueous or non-aqueous slurry form having a high viscosity; to be able to achieve, in the case of impregnation, up to 95 percent penetration, and to be able to obtain a coating material add-on by weight of the base web on the order of 350 to 500 percent. And it is particularly important to be able to do all this while at the same time producing on a substrate, either impervious or porous, a surface of such uniform texture and structure that it is free of the numerous defects mentioned above.

The creation of a machine, method and products thereof to accomplish these purposes is the general object of this invention.

SUMMARY OF THE INVENTION

The invention is embodied in an apparatus based on a support which can be either a flat, smooth table or a rotating drum. A coating material applicator in the form of an inverted, elongated, generally rectangular box structure extends with its long dimension across the support in the "cross machine" direction. Its two long transverse vertical walls provide first and second coating blade elements extending across the support with their lower edges in close proximity to the support surface. The lower edge of the first blade element is positioned above the table a slightly greater distance than is the lower edge of the second blade element.

Adjustment means such as micrometer and other screws and screw slots are arranged independently to adjust the heights of the lower edges of the blades above the support surface and with respect to each other.

End walls of the box structure are arranged with respect to the support in such a manner as to prevent escape of coating material while allowing the up and down adjustment of blade position.

Side dams may be provided extending upstream of the box structure along the support surface so as to confine coating material applied to the web from escaping sideways before it enters the box structure. In some embodiments these side dams may be extensions of the end walls of the box structure.

The box structure provides a confined area so as to form a pressure chamber.

While a web is being fed along the support and under the applicator, coating material is deposited in excess upon the web in front of, i.e., upstream of, the first blade element of the applicator. This area, formed by the first blade element, the side dams and the support, becomes a reservoir for the coating material.

The material is carried by the web under the first blade element and into the applicator where it builds up pressure in itself because it cannot escape from under the second blade element as fast as it enters. Thus, the box structure applicator forms a self-pressurizing pressure chamber. This self-generated, hydrostatic pressure drives the coating material into a porous web to penetrate and impregnate it, and in the coating of a non-porous web, it tends to drive the material into the web and fills any irregularities in the web surface. A coating is also built up and left on the web as it moves out from under the second blade, and its thickness is controlled by the distance of the lower edge of the second blade above the table, which doctors off the material and produces a smooth surface.

Penetration of a porous web is up to 95 percent or more, and coating weight add-on, depending on web porosity and coating material viscosity, is in the range of 300 to 500 percent or more by weight of the web.

Since the apparatus is capable of coating a non-porous substrate as well as of impregnating, i.e., filling or saturating and also simultaneously heavily coating a porous web with a highly viscous coating material, the term "coating" as used herein is intended to cover both operations, and likewise, the statement that the application "tends to drive the coating material into the web" covers both operations.

While the apparatus and method performed by it are primarily intended for such a simultaneous impregnating and coating operation, the apparatus is also capable of coating impervious surfaces without penetration. The term "web" as used herein is intended to cover any substrate which can be fed under the coating applicator such as tile or other ceramic or plastic materials, sheet metal and the like, as well as fibrous or other forms of porous sheets, either for the purpose of solely impregnating it, solely coating it or simultaneously impregnating and coating it.

Web-forming apparatus and associated equipment may be combined with the applicator so as to provide a system for producing coated or filled and coated end products from basic components.

In the embodiment constructed with the support as a flat table, means such as feed rolls are provided for drawing the web to be treated over the table and under the coating applicator.

An alternative embodiment is constructed with a rotatable drum as the web support and means are provided to rotate the drum to carry the web under the applicator.

Another alternative embodiment is an inverted double box structure having three transverse vertical walls providing first, second and third coating blade elements forming two successive pressure chambers. Coating material is deposited in front of the first blade element and forms a first coating in the first pressure chamber. Additional coating material, either the same as or different from the first, is introduced under pressure as by pipe-lines into the second pressure chamber to form an overcoat over the first coating and all before air can get to and adversely affect the surfaces between the coating layers.

Both the flat table and rotating drum support forms of apparatus may be constructed alternatively with the single or the double box structure forms of applicator.

DETAILED DESCRIPTION OF THE INVENTION

Figure 1:
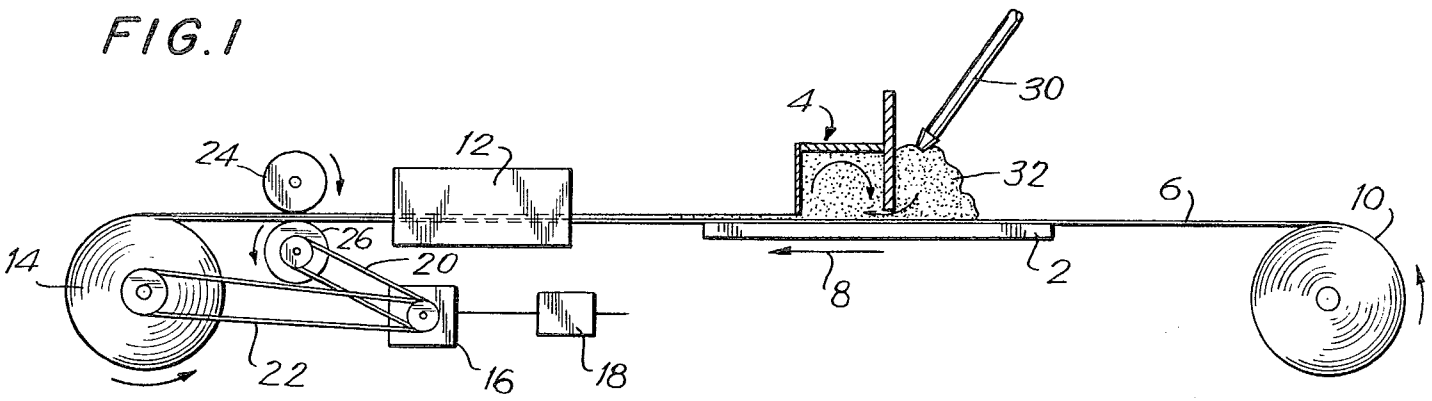
FIG. 1 is a general and partial elevation view of the apparatus of the invention, together with associated supply and wind-up reels, dryer and drive mechanism.

The applicator and its associated parts are best seen as a whole in FIG. 1. They include a web support in the form of a table 2, the coating material applicator indicated at 4 above and extending across the table 2 and means to feed a web 6 in the direction of the arrow 8 from a supply roll 10 along the table 2 and under the applicator 4 through a conventional dryer 12 and onto a wind-up roll 14. The feed means may comprise an electric motor 16 having a speed regulator 18 connected as by belts 20 and 22 to feed rolls 24 and 26 and to the wind-up roll 14.

Mechanism such as a hose 30 is arranged to deposit coating material 32 on the web 6 in front of the applicator 4, that is, upstream of the applicator with respect to the direction of feed of the web 6, as the web is being fed along the table 2 into and under the applicator 4. The hose is preferably arranged (by means not shown) to be reciprocated back and forth across the web to get even crosswise distribution of the coating material, or several hoses may be used. It is desirable to avoid using a mechanism which clogs when depositing viscous materials, especially those which include coarse fillers.

Figure 2:
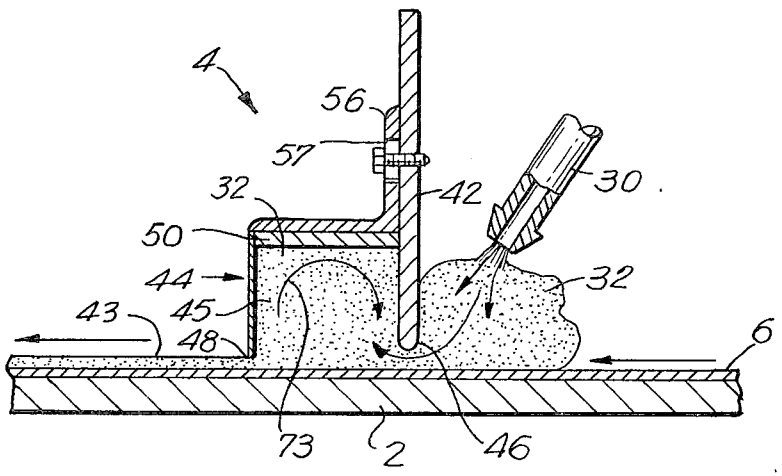
FIG. 2 is an enlarged elevation view of the coating material applicator looking in the across-the-machine direction with parts eliminated for clarity and partly in section.

Referring now to FIGS. 2 and 4–7, the applicator 4 is in the form of an inverted box secured to the table 2 and defining a confined zone. Two of its transverse vertical walls 42 and 44 provide first and second blade elements respectively extending across the table 2. The lower edges 46 and 48 respectively of the blade elements 42 and 44 are adjustably positioned in close proximity to the table 2 as best seen in FIG. 2, thus forming a restricted entrance and exit for the confined zone. The lower edge 46 of the first blade element 42 is normally positioned above the table 2 a slightly greater distance than the lower edge 48 of the second blade element 44. The box structure 4 has a top 50 and also end walls 52, the latter being best seen in FIGS. 5 and 7. The box structure of the applicator 4 in association with the table 2 forms the confined zone in the form of a pressure chamber 45 for the coating material 32 introduced into it and which operates as to be further described.

Figure 7:
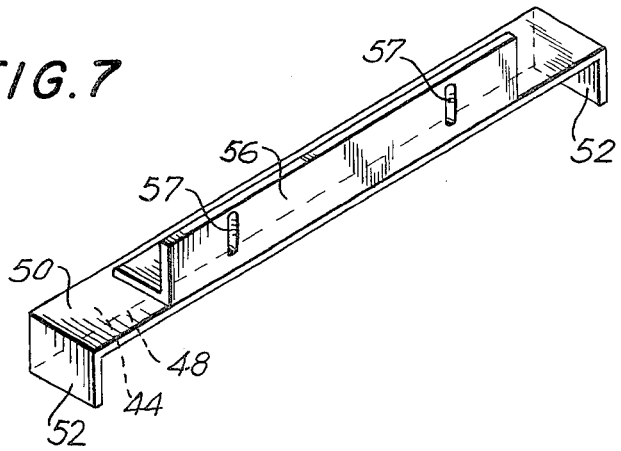
FIG. 7 is a perspective view of part of the structure which forms the second blade element and part of the pressure chamber of the applicator.

Also as seen in FIG. 7, part of the box structure of the applicator 4 may be formed as a single unit comprising the vertical wall forming the second blade element 44, the top 50 and the end walls 52. This unit has a bracket 56 on its top by which it is secured as by adjustment screws 58 to the vertical wall 42 forming the first blade element as best seen in FIG. 2.

Figure 4:
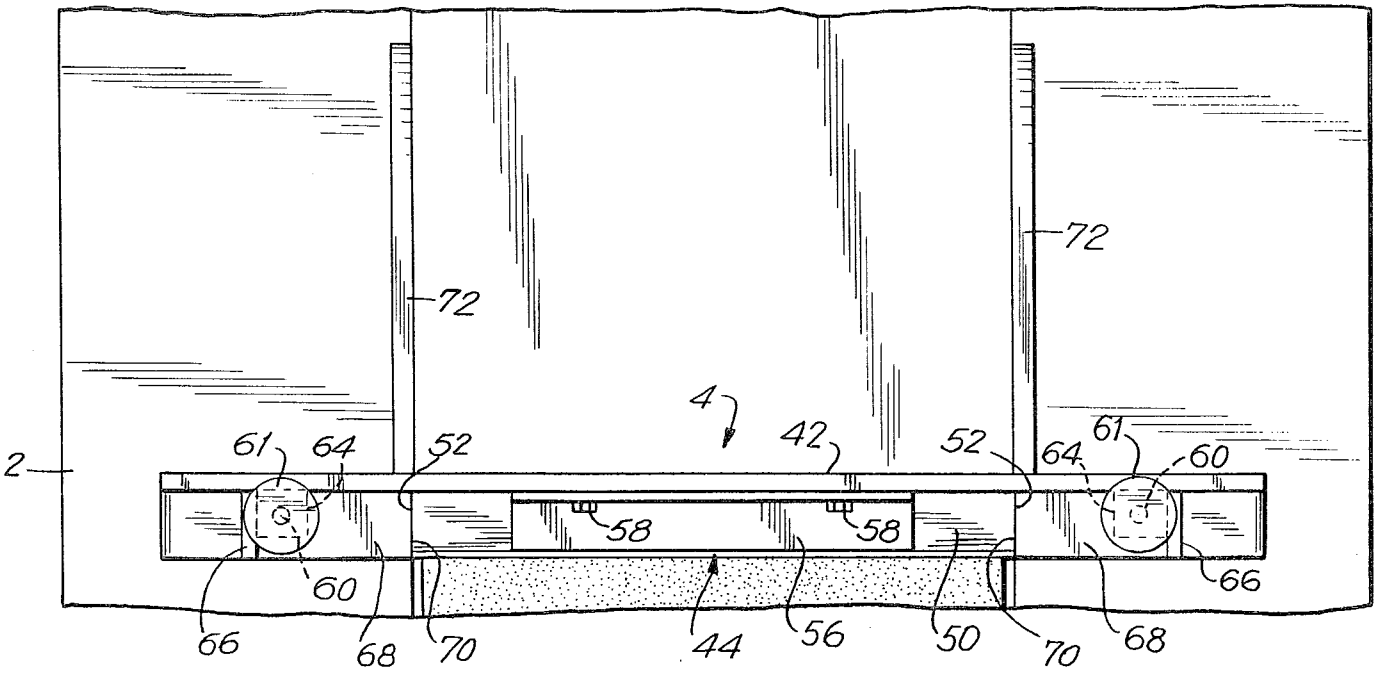
FIG. 4 is a plan view of the applicator.
Figure 5:
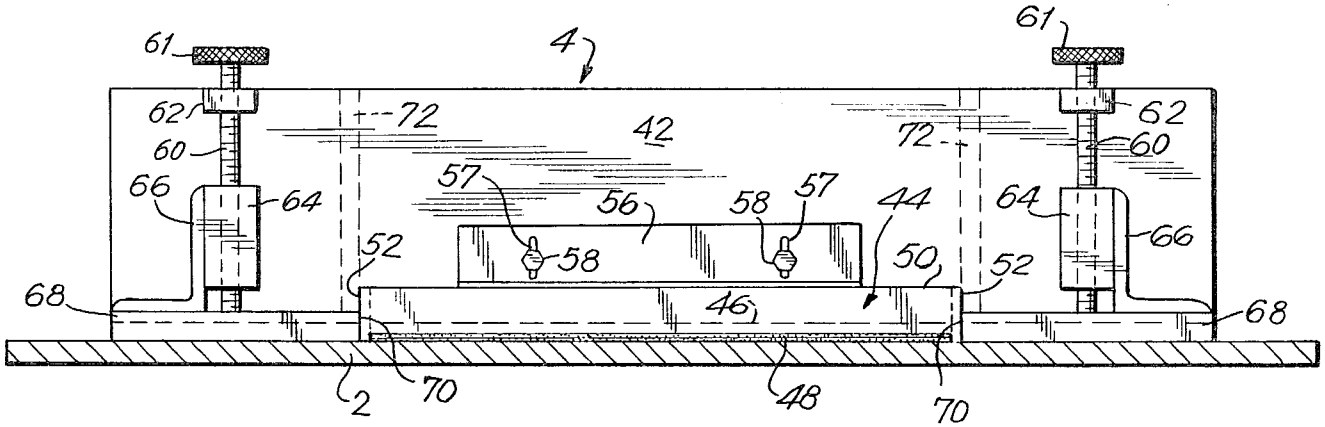
FIG. 5 is an elevation view of the applicator looking upstream of the machine direction.
Figure 6:
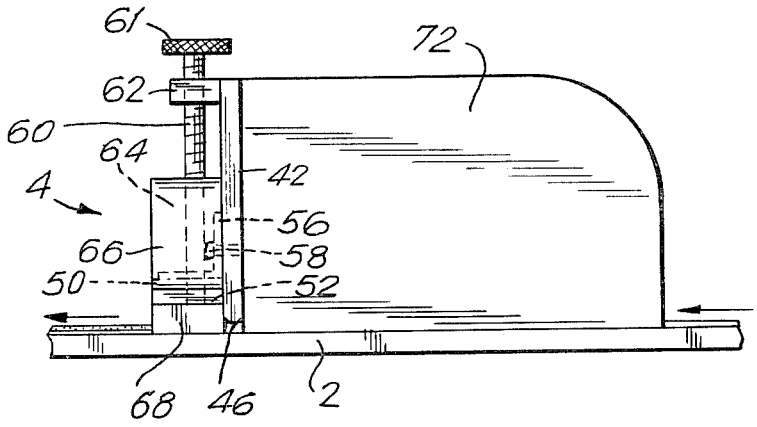
FIG. 6 is an elevation view of the applicator looking in the across-the-machine direction and somewhat similar to FIG. 2 but showing parts not shown in FIG. 2 and omitting others.

The clearance of the first blade element 42 may be adjusted by micrometer screws 60 having knurled turning heads 61 seen in FIGS. 4–6 and which are threaded into blocks 62 fixed on the blade element 42. The screws 60 are supported in columns 64 secured by brackets 66 to raised bases 68 against which the screws 60 work. The bases 68 in turn are fixed to the table 2. The inner ends 70 of the bases 68 are mated with sliding fits to the ends 52 of the applicator 4.

The slots 57 in the bracket 56 allow adjustment of the clearance of the lower edge 48 of the second blade 44 above the table 2 independently of the adjusted clearance of the lower edge 46 of the first blade element 42.

As seen in FIGS. 4–6, the table 2 has side dams 72 attached to it and which extend in the upstream direction from the first blade element 42 for confining coating material 32 which is deposited in front of the first blade element 42 to prevent it from escaping sideways. As seen in FIG. 6, the first blade element 42 is slidable up and down with respect to the side dams 72 to allow for its clearance adjustment above the table 2 but is supported in its vertical position on one side by the vertical edges of the side dams 72. The blade 42 is supported in its vertical position on the other side by the structure of the columns 64, the brackets 66 and the bases 68. The ends 70 of the bases 68, being in close abutment to the end walls 52 of the applicator box structure 4, prevent escape of the coating material 32 from under the end walls 52 while allowing for height adjustment of the box structure and resulting movement of the end walls 52. Any other leakages may be plugged after adjustment of the positions of the blade elements.

Referring again to FIGS. 1 and 2, when the coating material 32 is deposited by the hose 30 across the web 6 in front of the first blade element 42 as the web is being fed over the table under the applicator, the coating material 32 enters the pressure chamber 45 under the first blade element 42. When the blade elements are in their normal positions, the distance between the lower edge 46 of the first blade element 42 and the table 2 is greater than the distance between the lower edge 48 of the second blade element 44 and the table 2 so that the coating material enters the pressure chamber at a rate greater than that at which it may leave under the second blade element 44, thereby building up internal hydrostatic pressure in the coating material. The pressure which is applied to the web being coated by the coating material in the coating chamber is proportional to $(h_{46}-h_{48})/h_{46}$, where $h_{46}$ represents the distance between the lower edge 46 of first blade element 42 above the table 2 or other web support, and $h_{48}$ represents the distance between lower edge 48 of second blade element 44 above such web support. If the web 6 is porous, this pressure causes the coating material 32 to be driven downwardly into the web 6 and thus to impregnate and saturate or fill as well as coat the web 6 with the coating material. With a porous web the ratio of coating material forced into the web to the total amount applied to it is proportional to $(h_{46}-h_{48})/h_{46}$). If the web is non-porous, the material still tends to be driven down into it and thereby fills any surface irregularities. When the blades are at the same height, the entrance and exit rates of the material in and out of the applicator become equal and there is no pressure applied to the web, hence no filling action. The depth of the surface coating is, in any event, proportional to $h_{48}$.

As the coated web 6 leaves the applicator 4, the lower edge 48 of the second blade element 44 acts as a doctor blade to level off the coating at the thickness resulting from the adjusted clearance of the edge 48 above the table 2, thus providing a finished coating surface 43.

Figure 8:
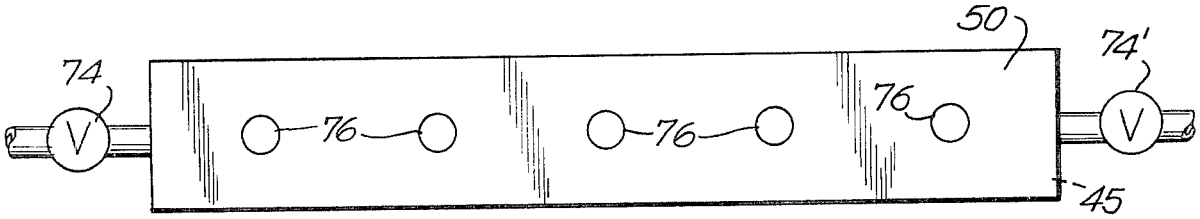
FIG. 8 shows in plan a modified form of the pressure chamber together with pressure relief valves.

The apparatus may have a number of different structures and procedures to regulate the coating material pressure in the applicator. For instance, the pressure may be regulated by adjusting the relationships between the rate of feed of the web 6 through the applicator as by the speed regulator 18, the rate of deposit of the coating material 32 and the clearances of the lower edges 46 and 48 of the applicator 4 above the table 2 and the web 6 passing under them. The coating material pressure built up in the pressure chamber 45 or 45*a* may also be adjusted by the use of one or more relief valves 74 and 74′ connected to the pressure chamber 45 as shown in FIG. 8, thus providing means to regulate the coating material pressure in the applicator.

These "tuning" adjustments thus provide a range of degree of penetration into porous webs by the coating materials which may be from around 100% down to 5% or lower, depending on the substrates and coatings chosen and used, while the design and function of the apparatus provides for a high degree of coating add on simultaneously with the substantial degrees of penetration above described.

The lower edge 48 of the second blade element 44 may be beveled downwardly toward its downstream side so as to create an additional downward pressure on the coating material passing under it. The lower edge 46 of the first blade element 42 may be shaped in the same manner for the same purpose.

Figure 12:
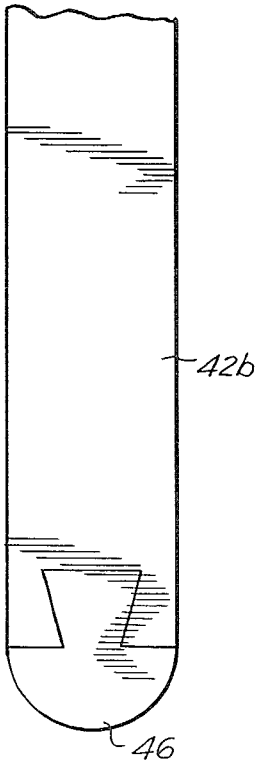
FIG. 12 is a partial end elevation view of a modified form of first blade element having a removable insert forming its bottom edge.
Figure 13:
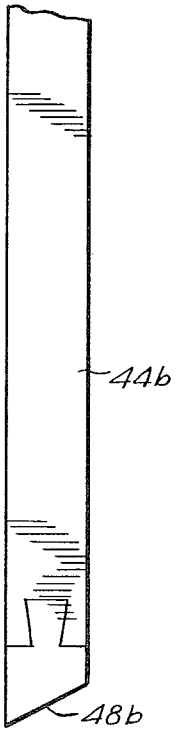
FIG. 13 is a partial end elevation view of a modified form of second blade element having a removable insert forming its bottom edge.

For convenience in replacing worn blade edges, or to provide edges having varying cross sectional shapes, the blade elements may be formed as seen in FIGS. 12 and 13, in which a first blade element **42*b* has a removable insert 46*b* providing a rounded bottom edge as seen, and in which a second blade element 44*b* has a removable insert 48*b*** providing a downwardly slanting bottom edge as seen. As above indicated, other bottom edge shapes may be provided by other inserts. The material of the inserts may be the same as that of the major portion of the blade elements, or may be different for special purposes.

Surprisingly, deposits of coating materials do not build up inside the pressure chamber 45 of the present invention, even over a long period of use.

Moreover, even highly viscous coatings and those with coarse fillers may be applied without streaking using this apparatus. Observation of the operation of a prototype of the invention has led to the belief that the pressurized coating material 32 in the pressure chamber 45 rotates in a clockwise direction as indicated by the arrow 73 in FIG. 2 resulting in what might be called a rotating log of coating material. It is felt that this rotational action prevents streaking of the coating and build-ups of coating material.

Figure 3:
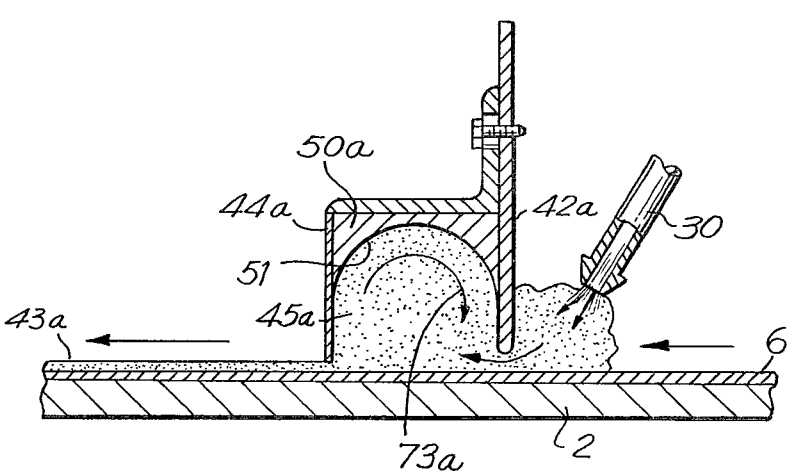
FIG. 3 is a view similar to FIG. 2 showing a modified form of the applicator.

The rotating log action of the coating material inside the pressure chamber may be enhanced by the modified form of the applicator structure shown in FIG. 3. This has first and second blade elements **42*a* and 44*a* essentially similar to those shown in FIG. 2 or which may be as shown in FIGS. 1 or 12 and 13 but also has a top 50*a* providing an upper part of an interior surface 51 formed with a section having a portion which is rounded in the machine direction of the application and which in the embodiment of FIG. 3 is cylindrical. This cylindrical or otherwise rounded interior in some causes enhances the rotating log effect of the coating material inside the pressure chamber 45*a* as indicated by the arrow 73*a*, thus improving the coating action and allowing the use of coating materials which are particularly difficult to apply to produce a good coating surface 43*a***.

As seen in FIG. 8 the pressure chamber 45 may also have ports 76 in its top 50 through which pigments may be intermittently injected for providing a stippling or marbled effect in the material coated on the web 6 for decorative purposes.

Figure 11:
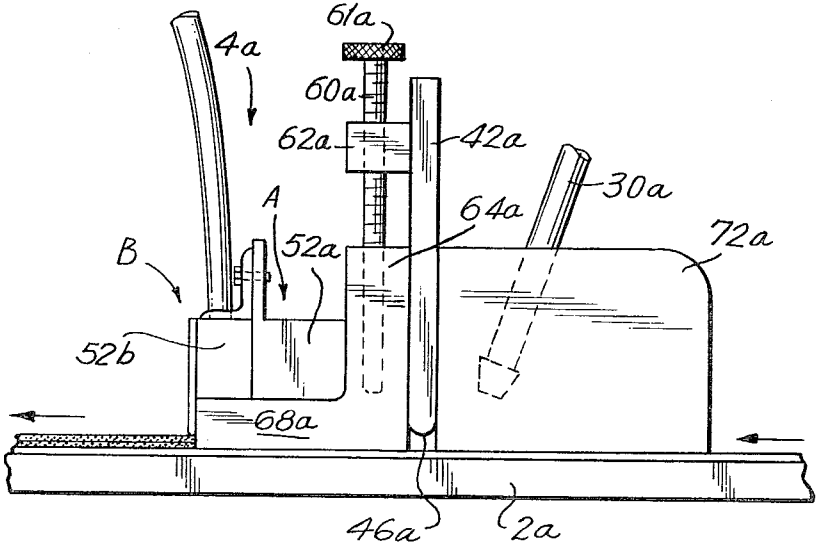
FIG. 11 is an elevation view of the alternative embodiment shown in FIG. 10 also looking in the across-the-machine direction showing parts not shown in FIG. 10 and eliminating others.
Figure 10:
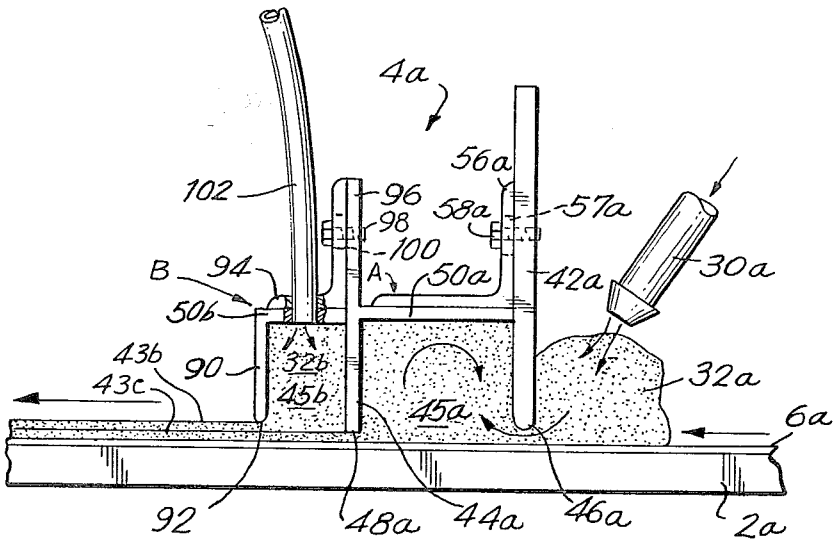
FIG. 10 is an elevation view of the alternative embodiment of the applicator which comprises the double box structure looking in the across-the-machine direction with parts eliminated for clarity and partly in section.

An alternative embodiment of the applicator is shown in FIGS. 10 and 11 and indicated at **4*a*. This has a first blade element 42*a* and a second blade element 44*a* with bottom edges 46*a* and 48*a* respectively and a third blade element 90 having a bottom edge 92**. These blade elements, together with their associated parts, form a first box structure, or part A, and a second box structure, or part B, providing first and second pressure chambers or confined areas.

Referring to FIG. 11 and comparing it to FIGS. 4–6 it will be seen that the support elements and other related parts are similar to those described above and illustrated with respect to the first embodiment.

The first blade element **42*a* has adjustment screws 60*a* having knurled turning heads 61*a* threaded into blocks 62*a* attached to the blade element 42*a* and seated and supported in columns 64*a* and bases 68*a***.

Similarly, side dams **72*a* are provided to confine coating material 32*a* deposited in front of the first blade element 42*a* from a hose 30*a* or other suitable dispersing device on a web 6*a* moving under the applicator 4*a* over a table 2*a***.

As well as the transverse vertical walls **42*a*, 44*a* and 90, the structure 4*a* has top portions 50*a* and 50*b* and end walls 52*a* and 52*b* so that it can be described as an inverted double box structure having a pair of first and second pressure chambers 45*a* and 45*b***.

As in the previously described embodiment, the portion of the structure formed by the second blade element **44*a*, the top 50*a* and the end walls 52*a* may be formed as a single unit and attached to the first blade element 42*a* as by a bracket 56*a* which has vertical screw slots 57*a* and is retained against the blade elements 42*a* by screws 58*a* through the slots 57*a*. Thus, the height of the bottom edge 48*a* of the blade element 44*a* may be adjusted up and down in proximity to the surface of the web 6*a* on the table 2*a* by loosening the screws 58*a***.

Likewise, the second part of the box structure may be formed of the top **50*b*, the wall or blade element 90 and the end walls 52*b* as a single unit secured as by a bracket 94 to an upwardly extending wall portion 96 of the blade element 44*a* as by screws 98 through vertical slots 100 which thus allow up and down adjustment also of the third blade element 90**. As in the first embodiment any residual leakages may be plugged by expedient means after adjustment of the parts.

Coating material **32*b* is supplied under pressure through one or more hoses 102 through the top 50*b* of the second box structure into the second pressure chamber 45*b* for laying an additional thickness of coating having a surface 43*b* over the surface 43*c* established on the coating applied in the first pressure chamber 45*a***.

Such an additional coating application may be desirable either to build up an additional thickness of the same coating material or to add a finish coat of a material which is different from the base coat.

For instance, the first coat could be an inexpensive filler material, while the second coat could be a fine, thin but relatively expensive coating, applied "wet on wet" immediately after the first coat and without exposing the first coat to the atmosphere before applying the second coat. For many coating combinations, this is a distinct advantage which is not achieved with conventional tandem coating operations where the first coating is exposed to air before application of the second coat. And this single and simultaneous operation has inherent economic advantages over successive separate operations.

Figure 14:
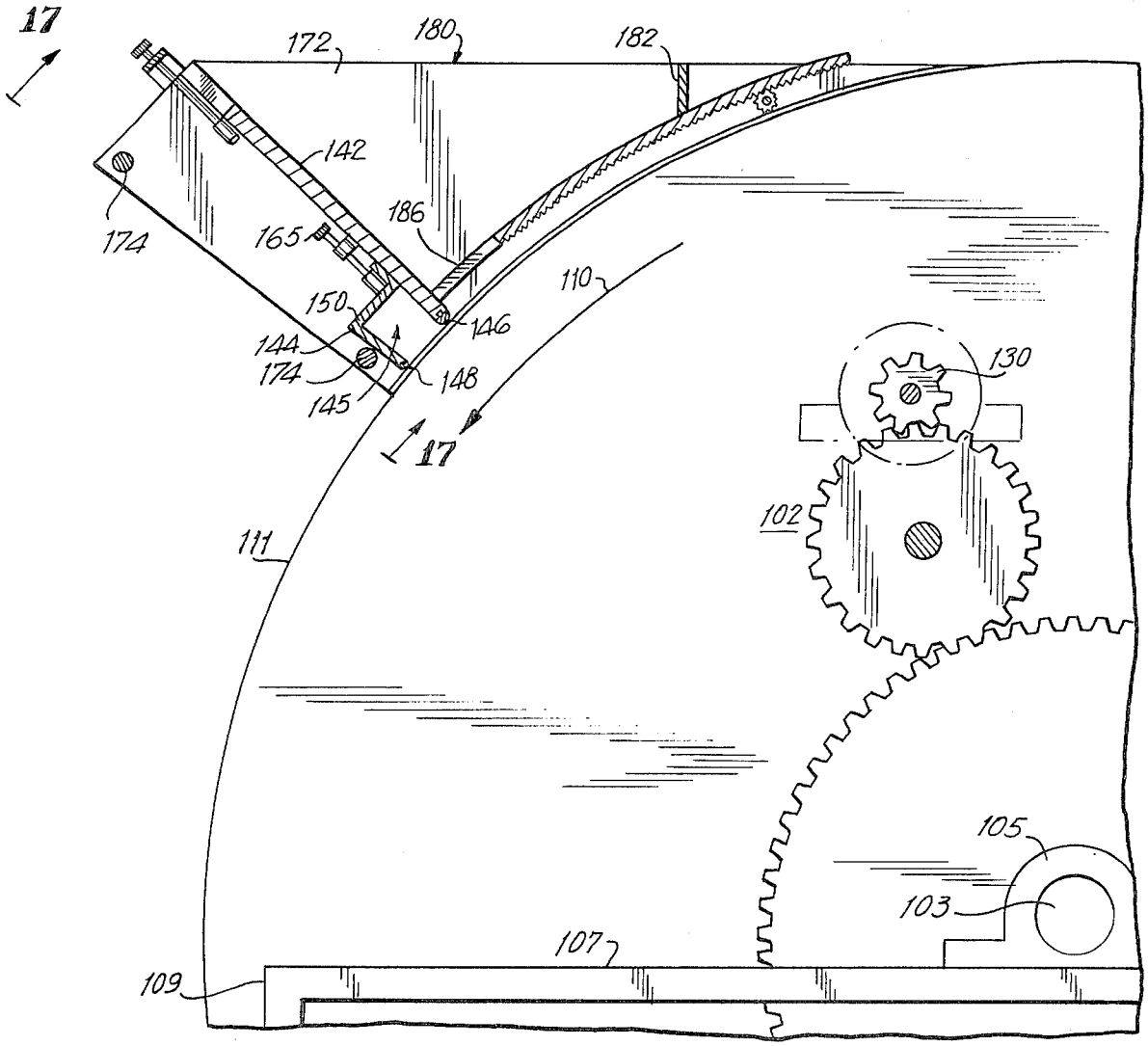
FIG. 14 is a partial end elevation view of another alternative embodiment in which the web support is a rotating drum, with parts removed.
Figure 15:
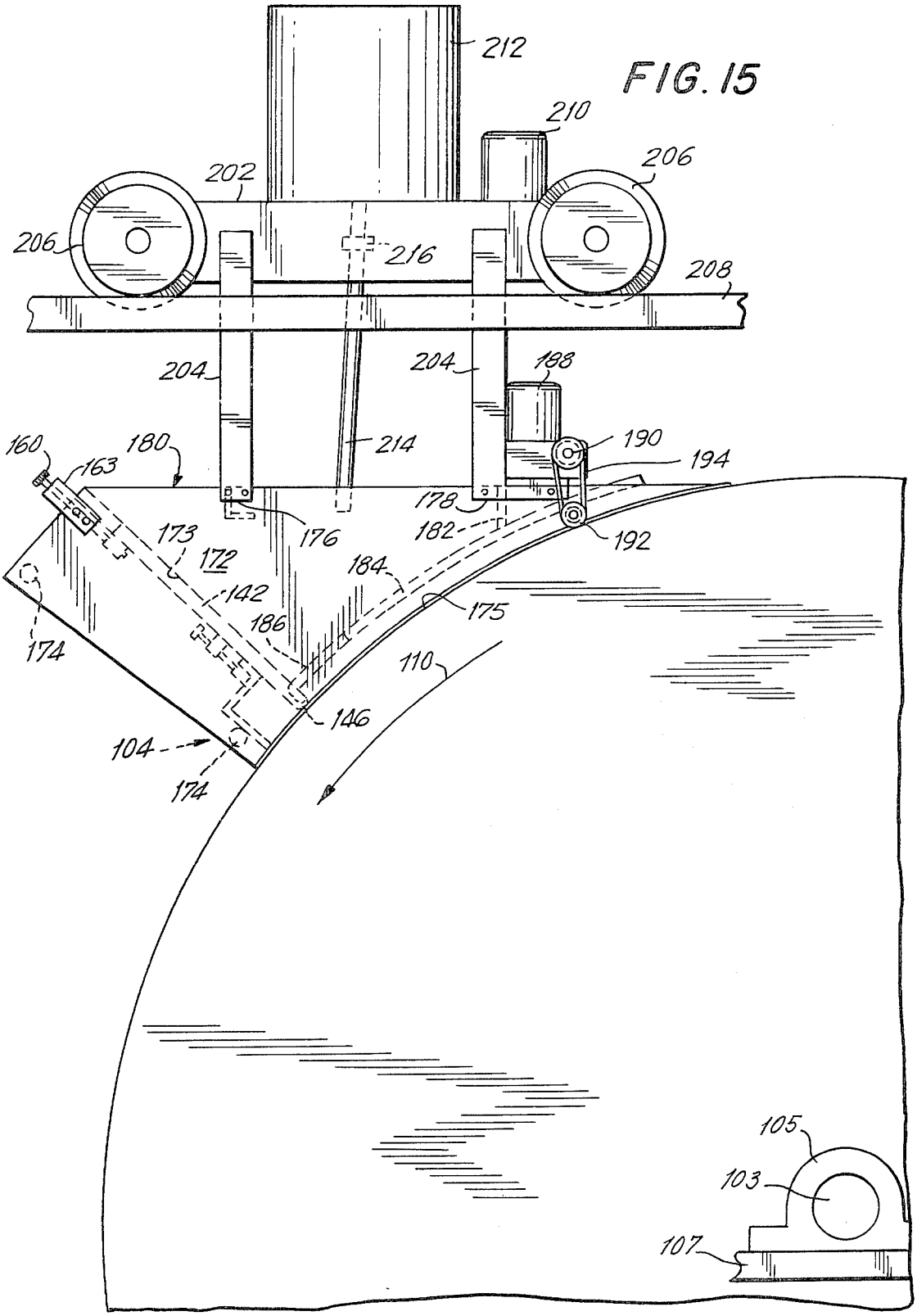
FIG. 15 is a partial end elevation view of the embodiment of FIG. 14 showing parts which were omitted in FIG. 14.
Figure 16:
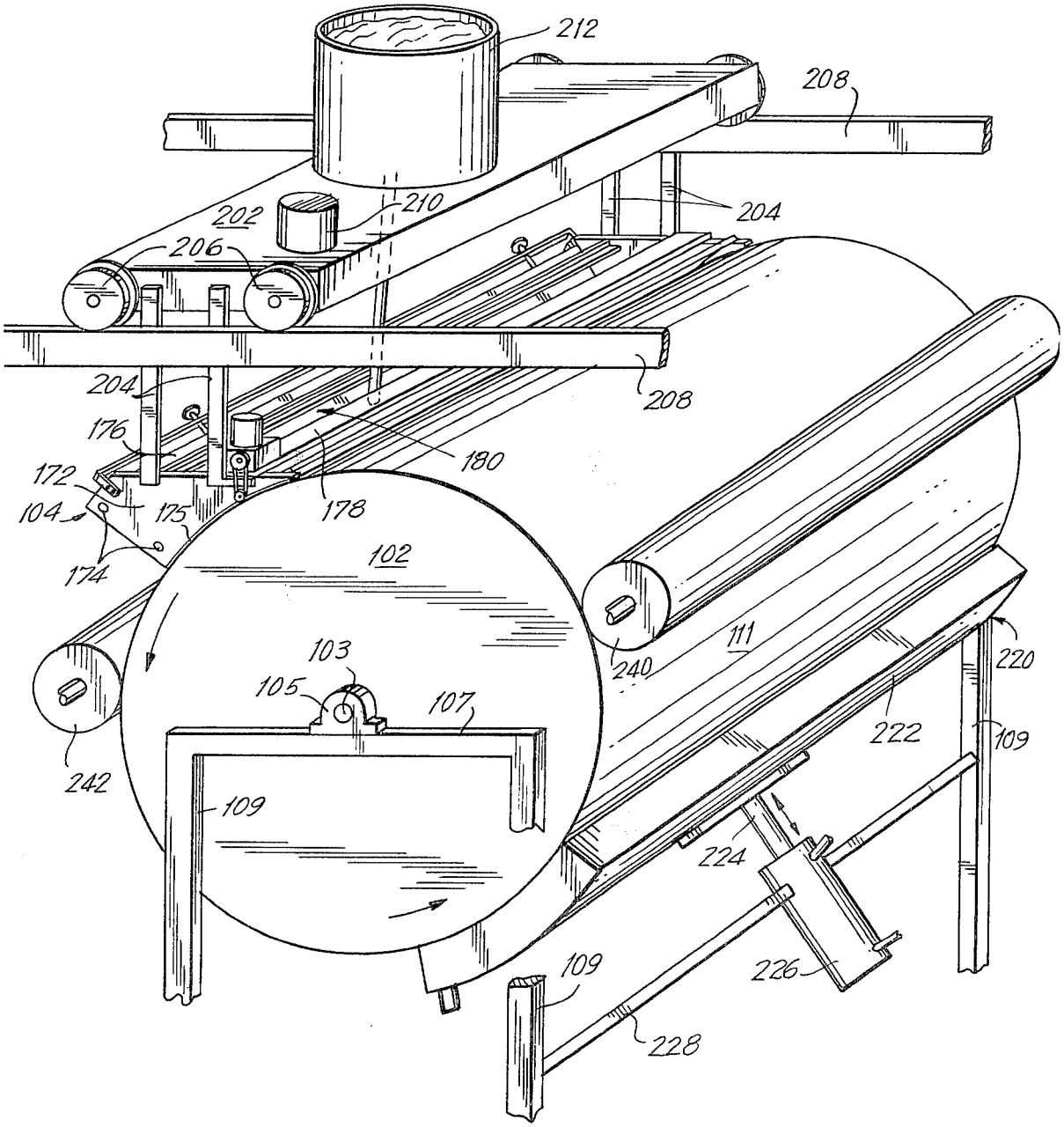
FIG. 16 is a perspective view of the embodiment shown in FIGS. 14 and 15 showing additional parts.

Another alternative embodiment of the apparatus is shown in FIGS. 14–21. In this form as best seen in FIGS. 14, 15 and 16 the web support is a drum 102 rotatable as by a motor 130 and drive linkage such as gears 132 and 134 indicated in FIG. 14 on an axle 103 supported in a bearing 105. The applicator 104 is supported as shown with respect to the drum by mechanism to be described, best seen in FIGS. 15 and 16.

The drum 102 and its bearing 105 may be conveniently mounted on a cross beam 107 and legs 109.

As seen in FIGS. 14–16, the applicator 104 is mounted at a level below the top of the drum 102 and at the downwardly moving surface of the drum when the latter is being rotated as indicated by the arrow 110 for a purpose to be further described.

As in the first previously described embodiment the applicator 104 has a first blade element 142 having a bottom edge 146, a second blade element 144 having a bottom edge 148 and a top 150 thus providing the inverted box structure which forms the confined zone in the form of a pressure chamber 145 where coating material is introduced into it on a moving web as previously described.

Figure 17:
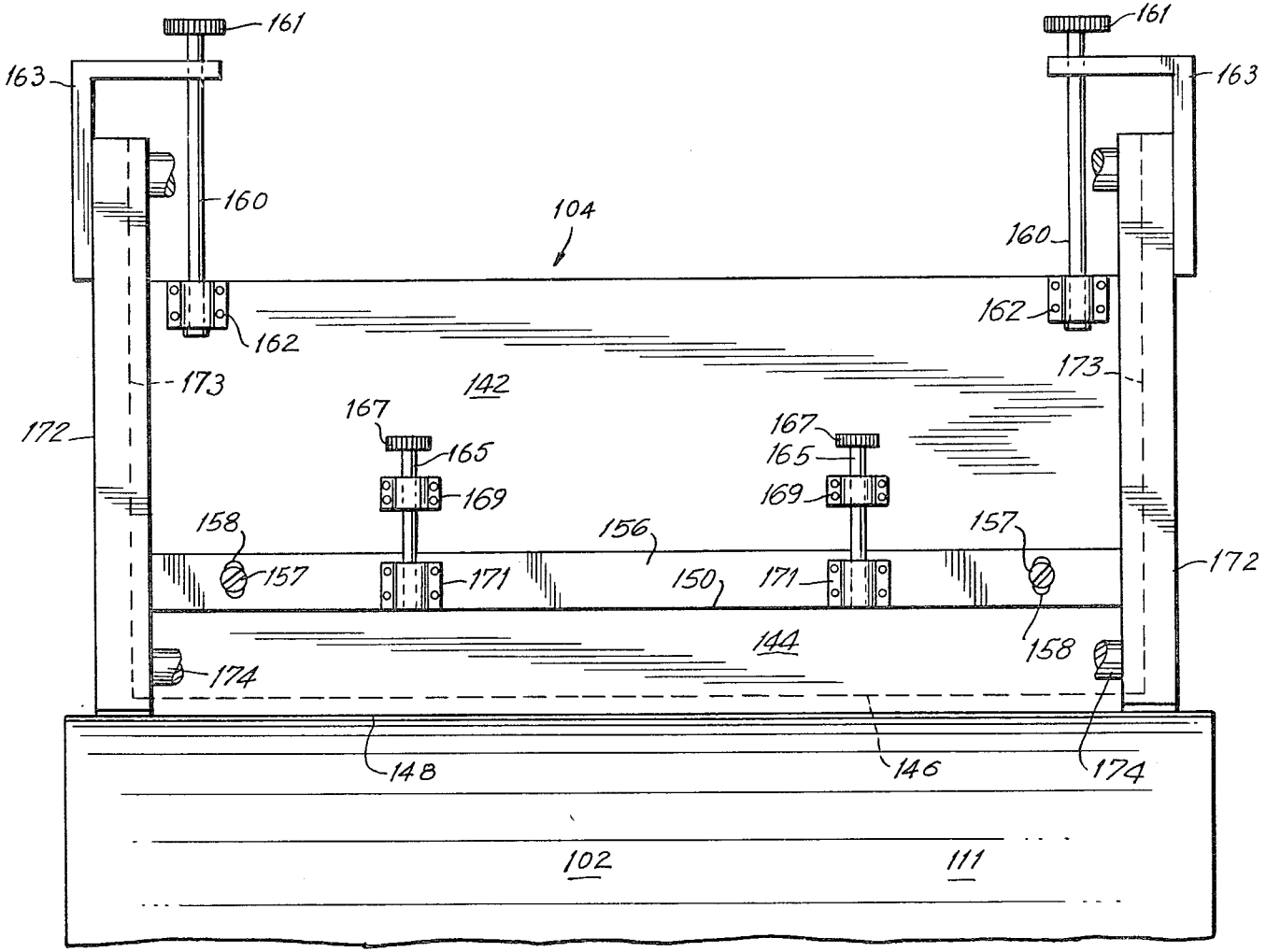
FIG. 17 is a partial front view of the embodiment of FIGS. 14–16 looking upstream of the direction of rotation of the drum surface 111 and taken along the lines 17—17 of FIG. 14 showing details of the adjustable mounting of the operative elements of the applicator 104.

By comparing FIGS. 14 and 17 it can be seen that since the second blade element 144 and the top 150 are integrally connected as one piece and the top has an upwardly extending bracket 156 which may also be formed as part of the integral unit, the second blade element 144 and top 150 are attached to the first blade element 142 by screws 157 passing through slots 158 in the bracket 156 and into the first blade element 142.

The applicator has side dams 172 seen in FIGS. 15, 16 and 17 having slots 173 which slideably receive the ends of the first blade element 142 thus securing the latter in operative position except for up and down adjustment. The clearance of the bottom edge 146 of the first blade element 142 with respect to the surface 111 of the drum 102 may be adjusted by micrometer screws 160 having knurled turning heads 161 supported by brackets 163 secured to the side dams 172 and threaded into blocks on the first blade element 142 as best seen in FIG. 17.

After thus adjusting the vertical clearance of the lower edge 146 of the first blade elements 142 the lower edge 148 of the second blade element 144 may be adjusted by micrometer screws 165 having knurled heads 167 threaded into blocks 169 and rotatably secured in blocks 171 on the bracket 156 as also best seen in FIG. 17.

The side dams 172 are maintained in rigid spaced relation by tie rods indicated at 174 in FIGS. 15, 16 and 17 and spacer bars 176 and 178 seen in FIGS. 15 and 16.

A reservoir 180 for coating material is thus provided by the first blade element 142, the side dams 172 and the surface 111 of the drum.

A back wall 182 and an arcuately shaped movable bottom wall 184 are provided as indicated and seen in FIGS. 14 and 15 to close the reservoir and retain the coating material in it to prevent spillage when the machine is stopped or the applicator 104 and its associated parts are moved away from the surface 111 of the drum 102 to allow threading of a web over the drum's surface 111 and under the applicator 104 or for other reasons.

The movable bottom wall 184 is slideable toward and away from the first blade element 142 in arcuate slots 186 in the insides of the side dams 172.

Figure 18:
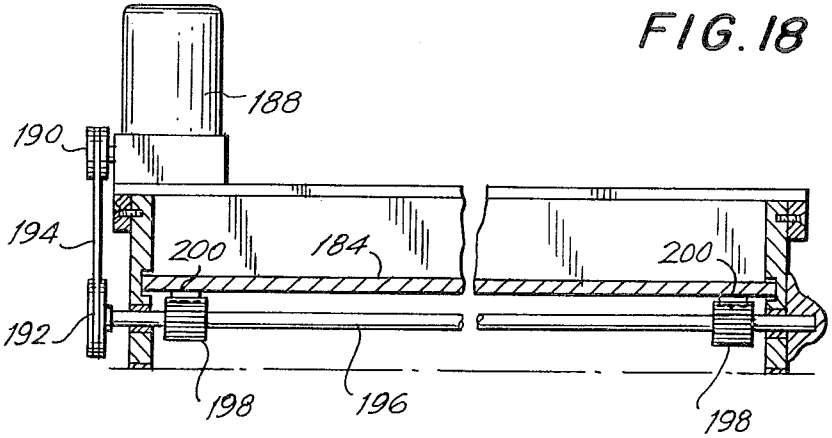
FIG. 18 is an elevation view partly in section showing details of the mechanism for operating the movable bottom wall.
Figure 19:
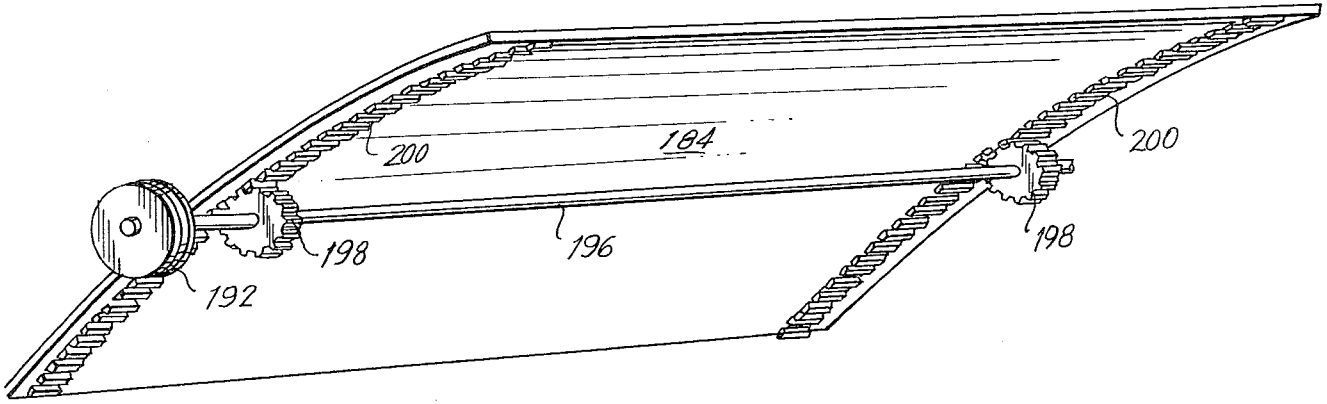
FIG. 19 is a perspective view of the underside of the movable bottom wall showing part of its operative mechanism.

As seen in FIGS. 15, 18 and 19 the bottom wall 184 is movable back and forth against and away from the first blade element 142 by a drive motor 188, pullies 190 and 192 and a belt 194. The pulley 192 turns a shaft 196 which in turn rotates gears 198 engaged with gear teeth 200 on the under side of the bottom wall 184.

Referring to FIG. 16, the applicator 104 and its associated parts above described are suspended in place against the drum 102 but movable away from the drum by means of a tram 202 to which they are attached by suspension bars 204. The tram 202 is movable to the left and right as seen in FIG. 16 on wheels 206 running on rails 208. The tram 202 may be driven as by an electric motor indicated at 210 attached by a driving linkage not shown, to one or more of the wheels 206.

When the applicator 104 is in operative position, the arcuate edges 175 of the side dams 172 are formed with a suitable material such as silicone rubber so as to provide a substantially liquid tight contact with the drum surface 111 so as to contain coating material within the reservoir 180 during operation.

A coating material supply tank 212 is mounted to ride on the tram 202 and to supply coating material into the reservoir 180 through a feed line 214 having a shut-off valve 216.

The drum-type apparatus includes means to remove accumulated excess coating material from the surface 111 of the drum 102 during intermittent operational steps which may occur when the applicator 104 is removed from the surface of the drum or even during operation in order to maintain the surface 111 as clean as possible.

Figure 20:
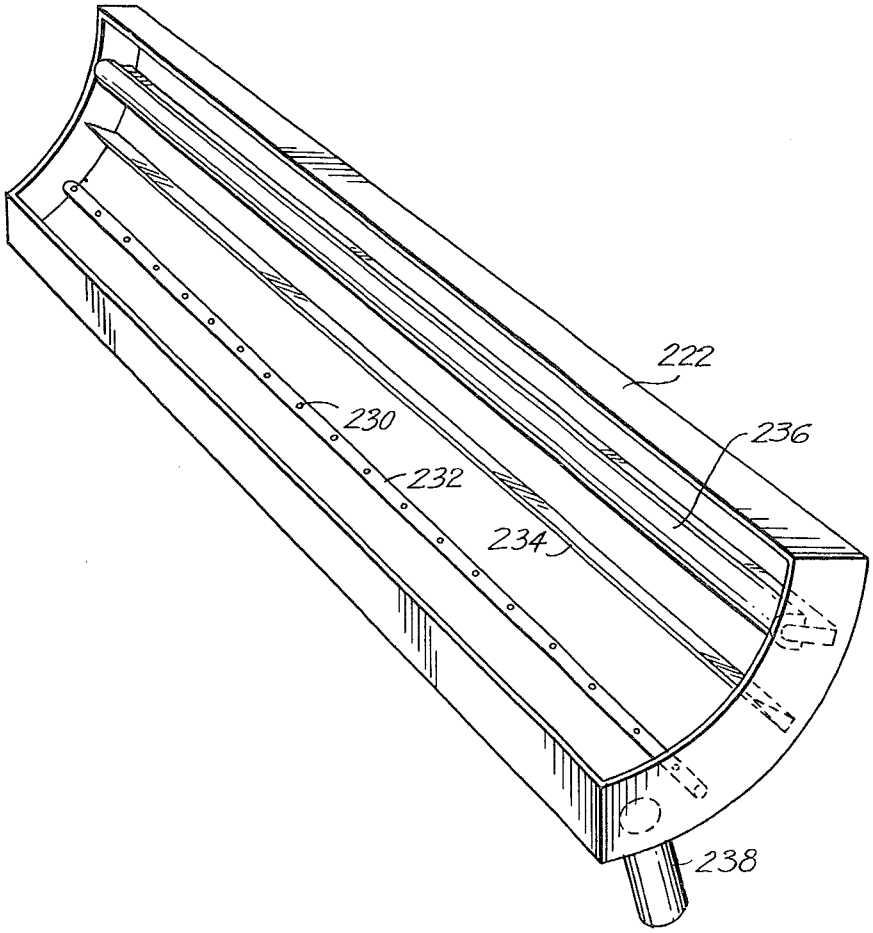
FIG. 20 is a perspective view of the drum cleaning device showing details of its operative parts.

This cleaning device 220 includes a housing 222 seen with its associated operative parts in operating position in FIG. 16 and in detail in FIG. 20.

The shell 222 of the cleaning device 220 may be applied to the surface 111 of the drum 102 and retracted from it by a piston 224 operated from a hydraulic cylinder 226 secured as on a beam 228 between two of the support legs 109 and seen in FIG. 16 and for which the hydraulic supply line and control are omitted because they are of standard design.

Referring to FIG. 20, as the surface 111 of the drum 102 passes upwardly in contact with the housing 222 for a cleaning operation, it is first washed by a series of water jets from jet apertures 230 in a pipe 232 connected by a line not shown to a pressurized water supply, thereby loosening at least some of the coating on the drum surface. What is not thus loosened is wiped off by a doctor blade 234 and then the drum surface is dried by a felt 236. The washings and scrapings are removed through a drain line 238 and thence to a disposal facility not shown.

Standard feed means are provided for introducing a web to be coated to the drum surface 111 and to remove it after it passes under the applicator 104. Such means might readily include a roll 240 to apply the web, not shown, to the drum surface 111 at a line about midway between the cleaning device 220 and the applicator 104 as seen in FIG. 16, and a driven take-off roll 242 on the opposite side of the drum 102.

The applicator 4 may be combined with a non-porous or porous web former and associated equipment so as to produce a coated or filled and coated end product from its basic components.

Figure 9:
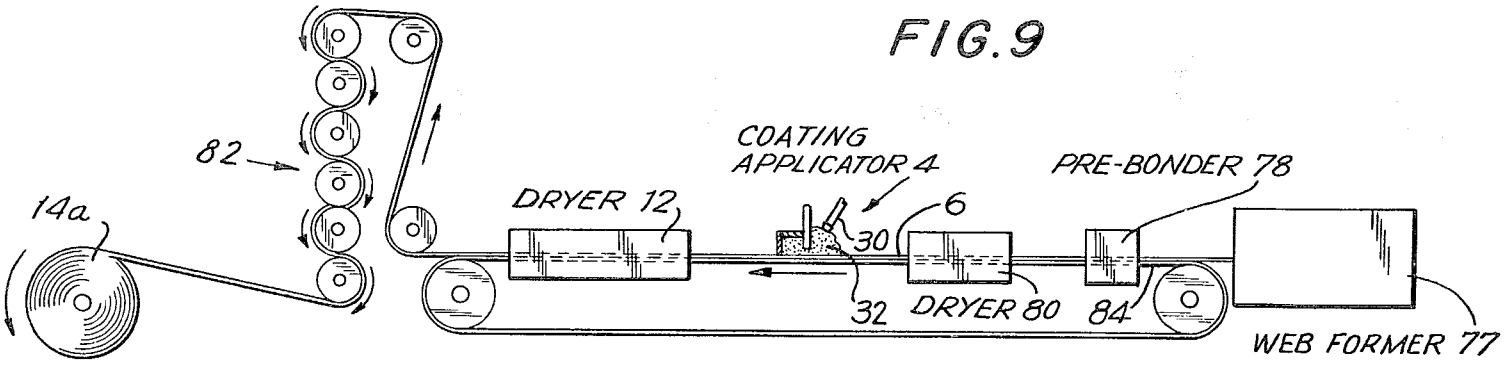
FIG. 9 is a schematic side elevation view of apparatus including the applicator of the invention for making a product from its basic components.
Figure 21:
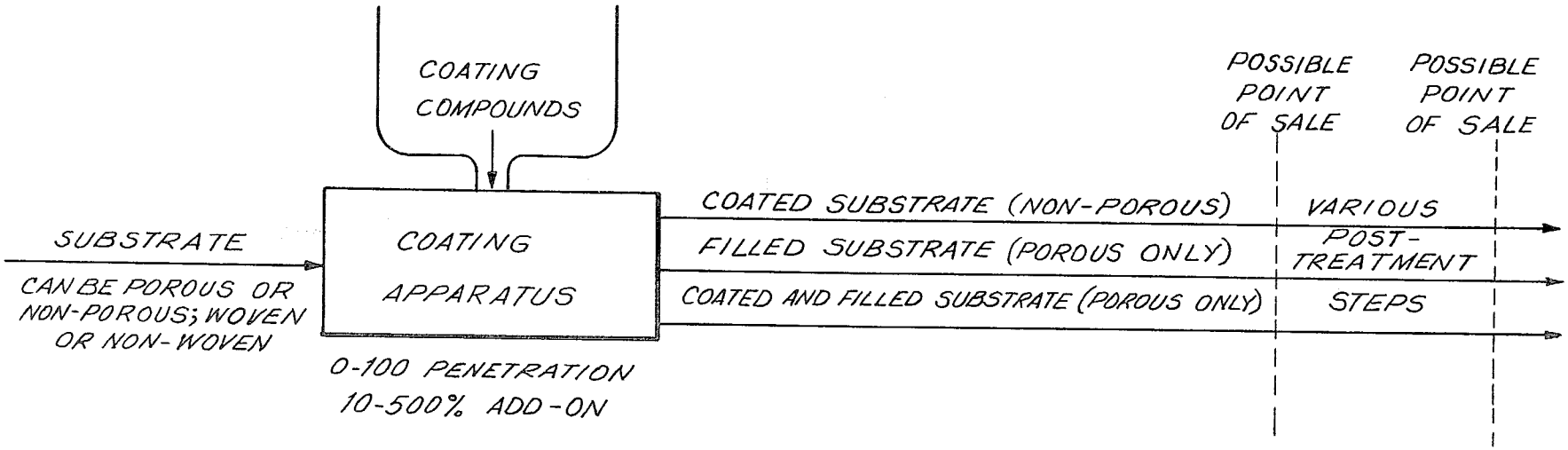
FIG. 21 is a schematic flow diagram showing in simplified form the process of and what is produced by the apparatus and method of the invention.

Such an arrangement is shown in FIG. 9 and includes a web former 77, a pre-bonder 78, a dryer 80, the coating applicator 4, the dryer 12, a calendar stack 82 and a wind-up roll 14*a*. A schematic flow diagram of the process steps is shown in FIG. 21.

The web former 77 may be any of a number of designs known or otherwise, for instance, one for forming a non-woven mat of man-made fibers such as nylon or polypropylene. The non-woven fiber web formed is fed out onto a carrier belt 84 and through the pre-bonder of known design 78 where a binder material, for instance comprising adhesive binder fibers, is deposited on the web to hold its fibers together during further treatment and handling. The pre-bonded web is carried throug the dryer to set the binder fibers cohesively together from which it emerges ready for coating by the applicator 4.

The coating material applicator 4 is capable of applying coating materials, otherwise herein called coating slurries or suspension materials, both aqueous and non-aqueous, which have a wide range of viscosities, for example 1,000–680,000 Centipoise, and which are preferably thixotropic at ambient temperatures. The viscosities stated herein are those measured and obtained in accordance with standard practice on a Brookfield machine. The most desirable suspension materials to be applied by the apparatus from a product interest point of view are aqueous and in the upper part of the range of viscosities.

By way of example, a carpet backing may be produced by applying to a needled carpet construction an aqueous slurry of the following formulation:

Water: 26.5 parts
Polyethylene Oxide—viscosity modifier: 0.5 parts
Clay—pigment: 39.0 parts
Titanium Dioxide—pigment: 16.0 parts
Ethylene Vinyl Acetate (55% solids)—Acrylic copolymer binder: 18.0 parts
Total solids: 65.4 parts
Viscosity: 120,000 Centipoise By thus coating the back side of the carpet with such a viscous material the fiber tufts are locked in place, the surface irregularities are smoothed out and an abrasion-resistant, crush-proof, smooth-surfaced backing is provided having excellent flexibility. In this case, the carpet is the web being coated, and being relatively non-porous the coating material does not penetrate and impregnate to any substantial extent.

A blockout screen may be produced from the porous web 6 saturated and coated with a non-aqueous slurry of the following formulation:

Dioctylphthalate Plasticizer (DOP): 14.7 parts
Vinyl Resin—powdered: 64.6 parts
Clay—pigment: 8.7 parts
Titanium Dioxide—pigment: 12.0 parts
Total solids: 85.3 parts
Viscosity:
Dioctylphthalate Plasticizer (DOP): 14.7 parts
Vinyl Resin—powdered: 64.6 parts
Clay—pigment: 8.7 parts
Titanium Dioxide—pigment: 12.0 parts
Total solids: 85.3 parts
Viscosity: 58,400 Centipoise The plasticizer Diisononyl Phthalate (DINP) may be substituted for the DOP in the above non-aqueous formulation.

The web for the blackout screen should be a porous non-woven material so that it can be saturated as well as coated, thus forming a reinforced but flexible fabric for the purpose.

What is claimed is:

1. A machine for coating a web with highly viscous material comprising a support for a moving web, an applicator in the form of an inverted box structure positioned during operation over the web support, and means for depositing coating material on the web in front of the applicator, the box structure having a top, end walls and transverse walls, the transverse walls providing first and second blade elements extending across the web support, the lower edges of said blade elements being adjustably positioned in close proximity to the web support thereby forming a pressure chamber and the lower edge of the first blade element being positionable above the web support a slightly greater distance than the lower edge of the second blade element whereby the coating material enters the pressure chamber under the first blade element at a rate greater than that at which it leave under the second blade element thereby building up coating material pressure in the chamber so that the coating material tends to be driven into the web, and whereby the second blade element doctors off the surface of the coating applied in the pressure chamber.

2. A machine according to claim 1 which includes means to feed the web on the web support under the applicator.

3. A machine according to claim 2 which includes means to change the rate of feed of the web on the web support under the applicator.

4. A machine according to claim 1 which includes means for independently adjusting the clearance of the lower edge of each of the blade elements above the support.

5. A machine according to claim 1 which includes means to adjust the rate of deposit of the coating material.

6. A machine according to claim 5 in which said coating material deposit means may operate to deposit the coating material at a rate faster than the coating material may escape from the applicator under the second blade element.

7. A machine according to claim 1 which includes means to regulate the coating material pressure in the applicator.

8. A machine according to claim 1 in which the top of the applicator is formed with a section having a portion which is rounded in the machine direction.

9. A machine according to claim 8 in which the rounded portion of the section is cylindrical.

10. A machine according to claim 1 in which the applicator has side dams extending in the upstream direction from the first blade element for confining coating material deposited in front of the first blade element.

11. A machine according to claim 7 which includes a pressure relief valve connected to the interior of the applicator for adjusting its internal pressure.

12. A machine according to claim 1 which includes at least one injection port in the structure of the applicator for injecting material into its interior during operation.

13. A machine according to claim 1 for making a coated fibrous web which includes a web former for forming the fibrous web and means to feed the web from the web former and under the applicator.

14. A machine according to claim 13 which includes a pre-bonder for binding the fiber together in the web as they leave the web former.

15. A machine according to claim 13 which includes a dryer for drying the web which leaves the web former before it reaches the applicator.

16. A machine according to claim 1 which includes a dryer for drying the coated web after it leaves the applicator.

17. A machine according to claim 1 which includes means to calendar the coated web.

18. A machine according to claim 1 in which the lower edge of at least one of the blade elements is beveled downwardly toward its downstream side so as to create an additional downward pressure on the material passing under it.

19. A machine according to claim 1 which has means to allow up and down adjustment of the position of the box structure with respect to the support while substantially preventing escape of coating material under the end walls from inside the chamber.

20. A machine according to claim 1 in which the web support is a table.

21. A machine according to claim 20 which includes means to feed the web over the table and under the applicator.

22. A machine according to claim 21 which includes means to change the rate of feed of the web along the table under the applicator.

23. A machine according to claim 1 in which the web support is a rotatable drum.

24. A machine according to claim 23 which includes means to rotate the drum to feed the web under the applicator.

25. A machine according to claim 23 which includes side dams extending from the ends of the first blade element in the upstream direction relative to the motion of the drum surface thereby forming, in combination with the first blade element and the drum surface, a reservoir for coating material deposited in front of the first blade element.

26. A machine according to claim 25 which includes means for closing off the bottom of the reservoir to prevent spillage of coating material.

27. A machine according to claim 23 which includes means for removing the applicator and associated parts from the surface of the drum to facilitate intermittent operational steps.

28. A machine according to claim 27 in which the said removing means includes a rail and a carrier movable along the rail away from the drum surface and supporting the applicator and associated parts.

29. A machine according to claim 23 which includes means to remove accumulated excess coating material from the surface of the drum during intermittent operational steps.

30. A machine for coating a web at least in part with highly viscous material comprising a support for a moving web, an applicator in the form of an inverted double box structure positioned during operation over the web support, the box structure having a top, end walls and three transverse walls, the three transverse walls providing first, second and third blade elements extending across the support, the lower edges of said blade elements being movably positioned in close proximity to the support thereby forming a pair of first and second pressure chambers, the lower edge of the first blade element being positionable above the support a distance slightly greater than the lower edge of the second blade element whereby, when coating material is deposited across the web in front of the first blade element when the web is being fed on the support under the applicator, the coating material may enter the first pressure chamber under the first blade element at a rate greter than that at which it may leave under the second blade element thereby building up coating material pressure in the first pressure chamber which tends to drive the coating material into the web thereby to apply a first coat to the web, and means to supply additional coating material under pressure into the second pressure chamber to apply a second coat over the first coat without exposure of the first coat to the atmosphere, the second blade element doctoring off the surface of the first coat and the third blade element doctoring off the surface of the second coat.

31. A machine according to claim 30 which includes means independently to adjust the distances of the lower edges of the blade elements above the support.

32. A machine according to claim 30 in which the web support is a table.

33. A machine according to claim 32 which includes means to feed the web over the table and under the applicator.

34. A machine according to claim 30 in which the web support is a rotatable drum.

35. A machine according to claim 34 which includes means to rotate the drum to feed the web under the applicator.

36. Method of coating a web, which comprises the steps of:

(a) moving the web;
(b) applying coating materials to the moving web;
(c) passing the web and coating material into and through a confined zone; and
(d) restricting the rate at which the coating material on the web leaves te confined zone whereby said coating material accumulates in the confined zone and builds up an internal hydrostatic pressure which tends to drive it into the web.

37. Method as defined in claim 36 wherein the web and coating material are passed into the confined zone through a restricted entrance and then out through a restricted exit.

38. Method as defined in claim 1 wherein the exit is restricted more than the entrance.

39. Method as set forth in claim 1 which includes the preliminary step of simultaneously and continuously forming the web from its constituent ingredients.

40. Method as set forth in claim 36 which includes the step of drying the coating material on the web after they leave the confined zone.

41. Method as set forth in claim 36 which includes the step of calendaring the coating material on the web after they leave the confined zone.

42. The method as set forth in claim 36 which includes the step of adding pigmenting material to the coating material in the confined zone.

43. Method as defined in claim 36 which includes the added steps of:

(a) passing the web and coating material through a second confined zone as they leave the first said confined zone;
(b) applying more coating material to the web in the second confined zone; and
(c) restricting the rate at which the more coating material on the web leaves the second confined zone whereby said more material accumulates in excess on the web before leaving the second confined zone.

44. The method as set forth in claim 43 which includes the step of adding pigmenting material to the coating material in one of the confined zones.

45. Method of coating a web, which comprises the steps of:

(a) moving the web;
(b) applying coating material to the moving web; and
(c) moving the web and coating material under a doctoring device having a predetermined clearance above the web and into a substantially closed pressure chamber and thence out again under a second doctoring device having a clearance above the web which is less than that of the first device whereby the coating material enters the chamber under the first device at a rate faster than it can leave under the second device and thereby builds up an internal hydrostatic pressure so as to tend to drive the coating material into the web.

46. Method as defined in claim 45 wherein the second doctoring device produces a smooth surface on the coating material leaving the pressure chamber on the web.

47. Method as defined in claim 45 which includes the step of varying the thickness of the finished coating by changing the clearances of the doctoring devices relative to each other and the web.

48. Method as defined in claim 45 which includes the steps of:

(a) moving the web and coating material immediately out from under the second doctoring device and into a second substantially closed pressure chamber;

(b) applying more coating material to the web in the second pressure chamber; and (c) moving the web and accumulated coating material out of the second pressure chamber and under a third doctoring device thereby producing a smooth surface on the more coating material supplied in the second pressure chamber.

49. Method as defined in claim 48 wherein the said more coating material is applied under pressure to the web in the second pressure chamber.

50. Method of simultaneously impregnating and coating a porous web, which comprises the steps of:

(a) moving the web;

(b) applying to the moving web a coating material comprising a suspension having a viscosity between 1,000 and 680,000 Centipoise;

(c) passing the web and coating material through a confined zone; and (d) restricting the rate at which the coating material leaves the confined zone to such an extent that the coating material accumulates in the confined zone and builds up an internal hydrostatic pressure sufficient to impregnate the web to a degree of penetration of at least 50 percent and with an add-on including the resulting coating on the web of at least 100 percent by weight of the uncoated web.

51. Method as defined in claim 50 in which the coating material is substantially an aqueous suspension.

52. Method as defined in claim 50 in which the coating material is substantially a non-aqueous suspension.

* * * * *